United States Patent [19]

Faria

[11] Patent Number: 4,643,961

[45] Date of Patent: Feb. 17, 1987

[54] INFRARED CADMIUM SELENIDE PHOTOCONDUCTOR AND PROCESS OF MAKING SAME

[75] Inventor: Sixdeniel Faria, Towanda, Pa.

[73] Assignee: GTE Products Corporation, Stamford, Conn.

[21] Appl. No.: 443,403

[22] Filed: Nov. 22, 1982

[51] Int. Cl.[4] ..... G03G 5/082

[52] U.S. Cl. ..... 430/136; 430/94

[58] Field of Search ..... 430/94, 136, 95

[56] References Cited

U.S. PATENT DOCUMENTS 3,895,943 7/1975 Hanada et al. ..... 430/136

*Primary Examiner*—J. David Welsh

*Attorney, Agent, or Firm*—James Theodosopoulos

[57] ABSTRACT

An infrared responsive cadmium selenide photoconductor is prepared by blending cadmium selenide, copper-containing cadmium selenide mix and cadmium chloride, and then firing the blend at 425° C.

1 Claim, No Drawings

INFRARED CADMIUM SELENIDE PHOTOCONDUCTOR AND PROCESS OF MAKING SAME

This invention concerns electrophotoconductive materials. Some such materials are disclosed in U.S. Pat. No. 4,239,884. It is particularly concerned with photoconductors that are responsive to infrared radiation of the type required for gallium aluminum arsenide based laser printers. For this purpose cadmium selenide photoconductors are more suitable than cadmium sulfide or cadmium sulfo-selenide photoconductors because the cadmium selenide is more infrared responsive. However cadmium selenide as disclosed in the prior art, for example, U.S. Pat. No. 3,694,201, is not adequately infrared responsive for use in said laser printers because it is fired at too high a temperature.

This invention discloses a process for making copper and chloride activated cadmium selenide photoconductor that is suitable for use with said laser printers. The process involves blending cadmium selenide with copper containing cadmium selenide and cadmium chloride, and then firing the blend at about 425° C.

In a specific example 300 grams of CdSe were blended with 3 grams of CdSe:Cu mix (1 gram CdSe:Cu mix contains 0.01 gram Cu) and 15 grams of $CdCl_2$. The blend was fired at 425° C. for one hour in a flowing nitrogen atmosphere. The fired composition was washed in alkaline cyanide solution, wet sieved through 500 mesh nylon screen and dried. It was then evaluated for relative energy response over the range of 400 to 900 nanometers. The relative energy response in the infrared region was greater than that of prior art cadmium selenide photoconductors.

I claim:

1. The process of making an infrared responsive cadmium selenide photoconductor comprising the steps of preparing a blend of cadmium selenide, copper-containing cadmium selenide mix and cadmium chloride, and firing the blend at a temperature of about 425° C.

* * * * *